US005335683A

United States Patent [19]

Ledley

[11] Patent Number: 5,335,683

[45] Date of Patent: Aug. 9, 1994

[54] NON-SLIP SUPPORT SHOE FOR A WALKING AID

[75] Inventor: Robert S. Ledley, Silver Spring, Md.

[73] Assignee: National Biomedical Research Foundation, Washington, D.C.

[21] Appl. No.: 71,736

[22] Filed: Jun. 3, 1993

[51] Int. Cl.[5] ..... A45B 1/00

[52] U.S. Cl. ..... 135/84; 135/86; 135/82

[58] Field of Search ..... 135/77, 68, 82, 84, 135/86

[56] References Cited

U.S. PATENT DOCUMENTS

| | | | |
|---|---|---|---|
| 1,334,208 | 3/1920 | Ames | 135/82 X |
| 1,348,531 | 8/1920 | Amadio | 135/82 X |
| 2,227,113 | 12/1940 | Talamantes | 135/77 |
| 2,675,014 | 4/1954 | Powers | 135/82 |
| 2,888,022 | 5/1959 | Fanning | 135/82 |
| 3,251,372 | 5/1966 | Smith | 135/64 |
| 3,731,698 | 5/1973 | Buchalter | 135/62 |
| 3,881,504 | 5/1975 | Pfaff | 135/53 |
| 3,901,258 | 8/1975 | Montgomery | 135/47 |
| 4,450,850 | 5/1984 | McKenna | 135/78 |
| 4,510,957 | 4/1985 | Frank | 135/84 |
| 4,708,154 | 11/1987 | Edwards | 135/84 |
| 4,964,430 | 10/1990 | Janis | 135/78 |
| 4,977,914 | 12/1990 | Smerker | 135/81 |

FOREIGN PATENT DOCUMENTS

| | | | |
|---|---|---|---|
| 325939 | 11/1957 | Switzerland | 135/82 |

*Primary Examiner*—Carl D. Friedman
*Assistant Examiner*—Lan C. Mai
*Attorney, Agent, or Firm*—Joseph G. Seeber

[57] ABSTRACT

A non-slip support shoe for attachment to the end of any crutch or other walking aid comprises an attachment cylinder for attaching the shoe to the bottom of the crutch or walking aid; a pair of strip leaf springs, at least one of which is connected to the attachment cylinder; and a rubber sole provided on the bottom surface of a lower one of the strip leaf springs. In operation, when the maximum weight of a body is exerted on the crutch or walking aid, the strip leaf springs change configuration (i.e., flatten) so that the entire sole located on the lower strip leaf spring contacts the ground, thereby preventing slippage during use of the crutch or walking aid. Once the maximum weight of the body is removed, the strip leaf springs return to their original configuration so as not to interfere with the angled forward and backward positions of the crutch during use.

17 Claims, 3 Drawing Sheets

NON-SLIP SUPPORT SHOE FOR A WALKING AID

TECHNICAL FIELD

The invention generally relates to a non-slip support shoe for crutches or other walking aids. More specifically, the invention relates to a non-slip support shoe comprising a cylinder which is attached to the bottom end of a crutch or other walking aid, a pair of strip leaf springs forming the main part of the shoe, and a non-slip rubber sole attached to the bottom of the shoe so as to give lateral support to the crutch. The shoe is attached to the crutch end by a screw, pin, or other suitable means.

BACKGROUND ART

Whereas various crutches and walking aids have been well known in the art for some time, there has been a need for a device which, when connected to the crutch or other walking aid, provides an effective mechanism for preventing slippage of the foot or shoe of the crutch while in use.

The following patents typify the prior art relative to the present invention: Smith U.S. Pat. No. 3,251,372; Buchalter U.S. Pat. No. 3,731,698; Platt U.S. Pat. No. 3,881,504; Montgomery U.S. Pat. No. 3,901,258; McKenna U.S. Pat. No. 4,450,850; Frank U.S. Pat. No. 4,510,957; Edwards U.S. Pat. No. 4,708,154; Janis U.S. Pat. No. 4,964,430; and Smerker U.S. Pat. No. 4,977,914.

Prior art arrangements, such as those found in the above-mentioned patents, do not give maximum stability when maximum weight is exerted on the crutch, often make a hole in the floor or ground surface while the crutch is in use, often experience interference of the front and/or back ends of the shoe as the crutch is in use, often do not provide a replaceable shoe for the bottom of the crutch, and are relatively expensive to manufacture. Crutches of the prior art also do not provide cushioning of the impact of the crutch on the ground during use, often resulting in a jarring force to the user.

DISCLOSURE OF INVENTION

The present invention generally relates to a support shoe for attachment to the end of any crutch or walking aid. The inventive arrangement generally comprises a cylinder which attaches to the bottom end of the crutch, a pair of strip leaf springs forming the main part of the shoe of the crutch, and a non-slip rubber sole attached to the bottom surface (i.e., lower strip leaf spring) of the shoe to give lateral support to the crutch. The bottom surface is curved when little weight is applied to the crutch, so as not to interfere with the placement of the crutch on the ground in the angled forward and backward positions, but the bottom surface becomes flat as the maximum weight is applied when the crutch is vertical. The shoe is attached to the crutch end by a screw, pin or other suitable means.

In general operation, when maximum weight of the body is exerted on the crutch, the pair of springs flattens so that the entire shoe sole touches the ground at maximum force. However, when less than maximum force is exerted, the pair of strip leaf springs return to the curved original position. Thus, as a person walks and the crutch is placed forward, the back end of the curved shoe touches the ground. As the person bears down on the crutch and the crutch becomes vertical, the entire shoe sole contacts the ground. As the person continues to use the crutch, and the crutch is angled in the backward direction, only the front of the now curved shoe touches the ground.

A primary advantage of the aforementioned device and its operation resides in the fact that, as the maximum weight is applied to the crutch and the maximum tendency to slip occurs, maximum contact is made between the sole of the shoe and the ground, thereby tending to prevent any slipping. A further advantage of the device and its operation resides in the fact that the shoe does not interfere with the forward and backward motion of the crutch during use. Moreover, the design of the shoe is such that it gives the user of the crutch a degree of safety from slipping previously unattained and unexperienced with crutches of the prior art. Furthermore, the shoe of the present invention is easy to install on the end of any conventional crutch or walking aid. Thus, when the sole wears too much, the shoe can be easily and inexpensively resoled or replaced.

It should be noted that, in contrast to devices of the prior art, the present invention provides maximum stability at maximum weight on the crutch, while at the same time not making a hole in the floor or ground surface, and while also enabling forward and backward motion of the crutch without interference of the front and back portions of the shoe as the crutch is angled while walking with the crutch.

Therefore, it is a primary object of the present invention to provide a non-slip support shoe.

It is a further object of the invention to provide a non-slip crutch shoe wherein, as maximum weight is applied to the crutch, maximum contact is made between the sole of the shoe and the ground, thereby tending to prevent slippage.

It is an additional object of the present invention to provide a non-slip crutch shoe which is relatively inexpensive to manufacture, and which is easily replaceable when the sole becomes worn.

It is an additional object of the present invention to provide a non-slip crutch shoe which eliminates interference with forward and backward motion of the crutch during use thereof.

It is an additional object of the present invention to provide a non-slip crutch shoe which adapts its shape during the walking motion so that, as maximum downward force is applied to the crutch, there is maximum contact with the ground, and thus minimal slippage.

It is an additional object of the present invention to provide a non-slip crutch shoe which, in operation, provides increased safety of movement in any desired surroundings of the user, while also providing easy handling and use.

It is an additional object of the present invention to provide a non-slip crutch shoe which, in operation, provides cushioning of the impact of the crutch on the ground during use.

With the above and other objects in mind, the invention will now be described in more detail with reference to the detailed description, appended claims, and drawings.

BEST MODE FOR CARRYING OUT THE INVENTION

The invention will now be described in more detail with reference to FIGS. 1 thru 4, as described above.

Figure 2:
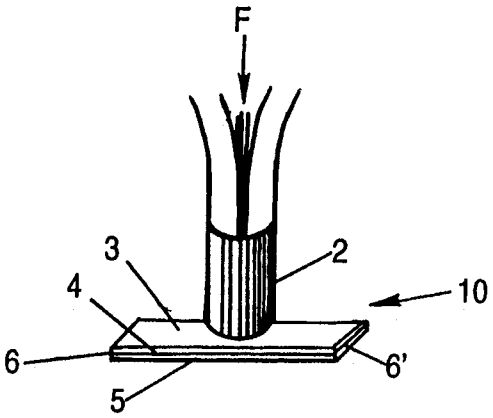
FIG. 2 is a view of the lower end of the crutch of FIG. 1, and shows the non-slip crutch shoe in its flattened configuration when maximum weight is applied to the crutch.
Figure 1:
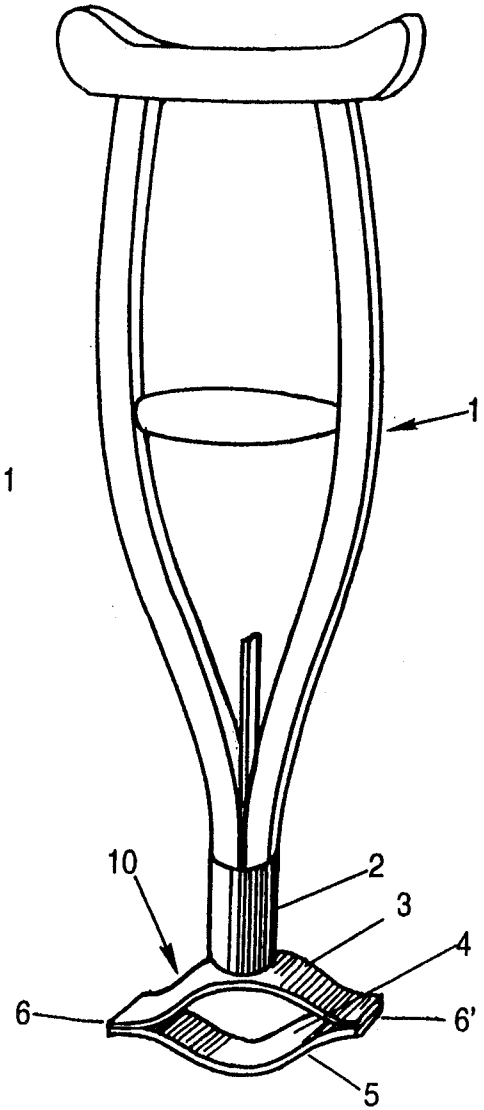
FIG. 1 is a representation of a standard crutch with which the non-slip crutch shoe of the present invention is employed, the non-slip crutch shoe being depicted in its configuration when no weight is applied to the crutch.
Figure 4:
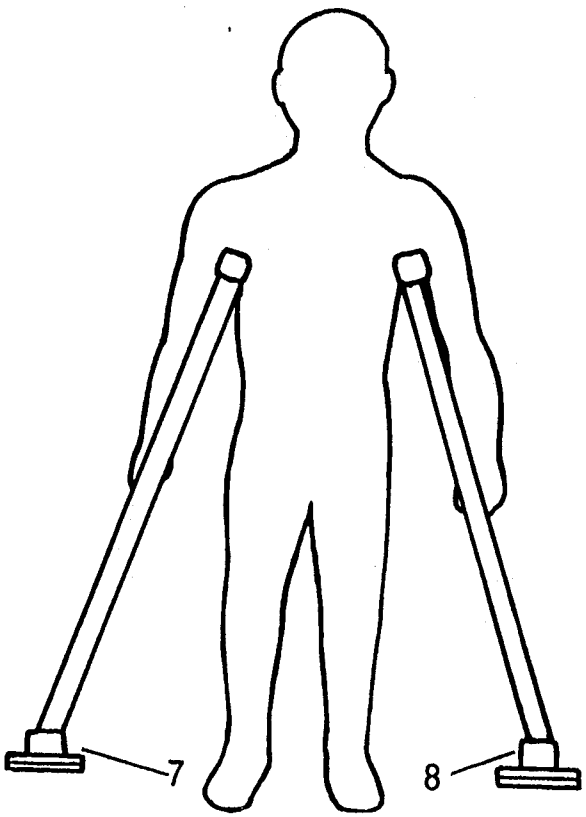
FIGS. 3 and 4 are a side view and a front view, respectively, depicting the use of the non-slip crutch shoe by a user.

Referring to FIGS. 1 and 2, a standard crutch 1 is equipped with a non-slip crutch shoe 10 in accordance with the present invention. The non-slip crutch shoe 10 comprises an attachment cylinder 2 for receiving the lower portion of the crutch 1, an upper strip leaf spring 3 connected to the lower portion of the attachment cylinder 2, a lower strip leaf spring 4 connected at each end 6 and 6' to corresponding ends of the upper strip leaf spring 3, and a sole 5 of rubber or other friction material disposed on the bottom surface of the lower strip spring 4.

During the assembly of the non-slip crutch shoe 10 on the crutch 1, once the lower portion of the crutch 1 is slipped inside of the attachment cylinder 2, a horizontally driven screw or pin, or other suitable means, can be used to secure the bottom portion of the crutch 1 within the attachment cylinder 2.

As mentioned previously, FIG. 1 shows the non-slip crutch shoe 10 in its unflattened, non-weight bearing configuration, while FIG. 2 shows the non-slip crutch shoe 10 in its flattened and weight bearing configuration. More specifically, in operation, when maximum weight of a body is exerted on the crutch 1, the springs 3 and 4 flatten so that the entire surface of the sole 5 contacts the ground. Once the weight of the body, represented by the downward force F shown in FIG. 2, is removed or diminished, the springs 3 and 4 return to their unflattened curved configuration, as shown in FIG. 1, so as not to interfere with the angled forward-/backward positioning of the crutch.

Thus, referring to FIGS. 1 thru 4, as a person walks and the crutch is placed forward, the back portion of the shoe (indicated, for example, by reference numeral 6) touches the ground. As the person bears down on the crutch 1, and the crutch 1 becomes vertical, the entire shoe sole 5 contacts the ground. As the person continues, and as the crutch is angled backward, only the front portion (represented, for example, by reference numeral 6') of the shoe 10 touches the ground.

Figure 3:
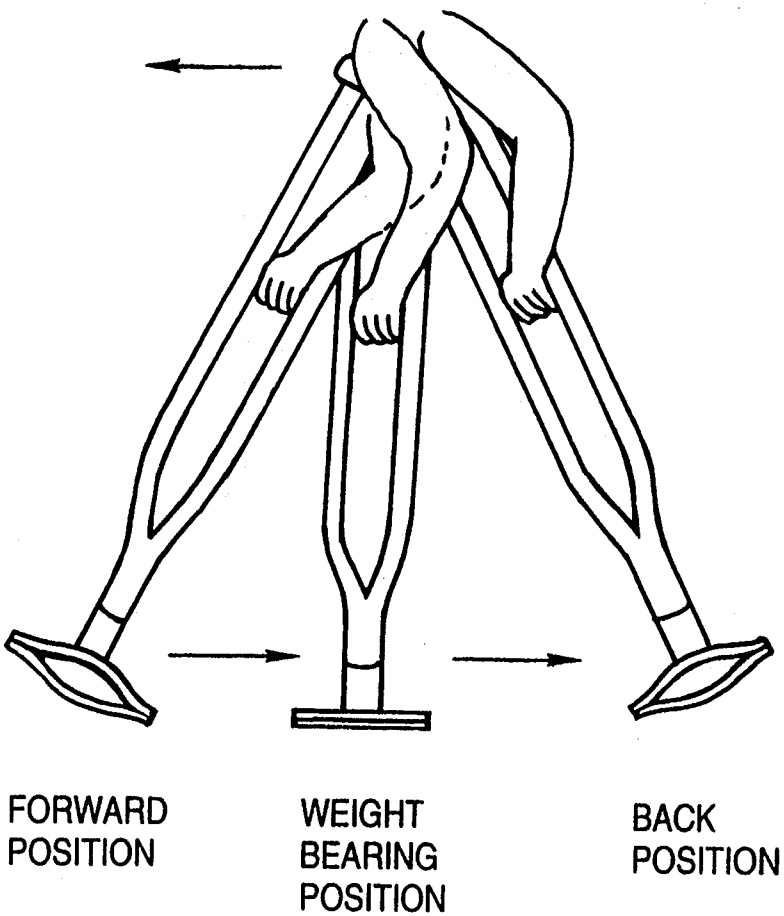

Thus, the primary advantage of non-slippage is achieved by the maximum contact between the sole 5 and the ground during use (as seen in FIGS. 2 and 3), while a further advantage of the device resides in the fact that, during use, the shoe 10 does not interfere with forward and backward motion of the crutch 1. Furthermore, the "spread out" configuration of the shoe 10 both prior to (see FIG. 1) and during (see FIG. 2) exertion of the force F prevents the crutch 1 and shoe 10 from making holes in the floor or ground surface during use.

It should be noted that the upper strip leaf spring 3 and lower strip leaf spring 4 are attached to each other at ends 6 and 6' by any suitable means that will not interfere with the action of the upper strip leaf 3 and lower strip spring 4 during use. However, it is considered preferable to employ a tab-slot arrangement for interconnecting the upper strip leaf spring 3 and lower strip leaf spring 4.

Figure 5A:
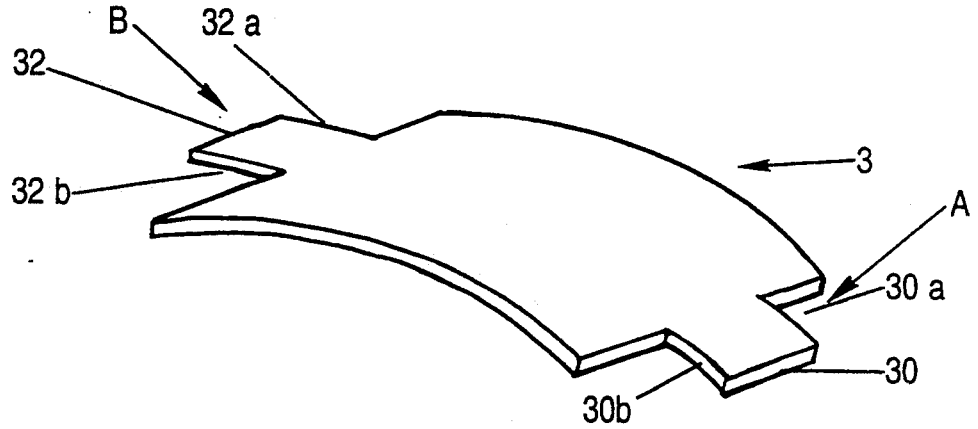
FIGS. 5A, 5B and 5C are perspective views of the upper strip spring, the lower strip leaf spring, and the upper and lower strip leaf springs in assembled arrangement, respectively.
Figure 5B:
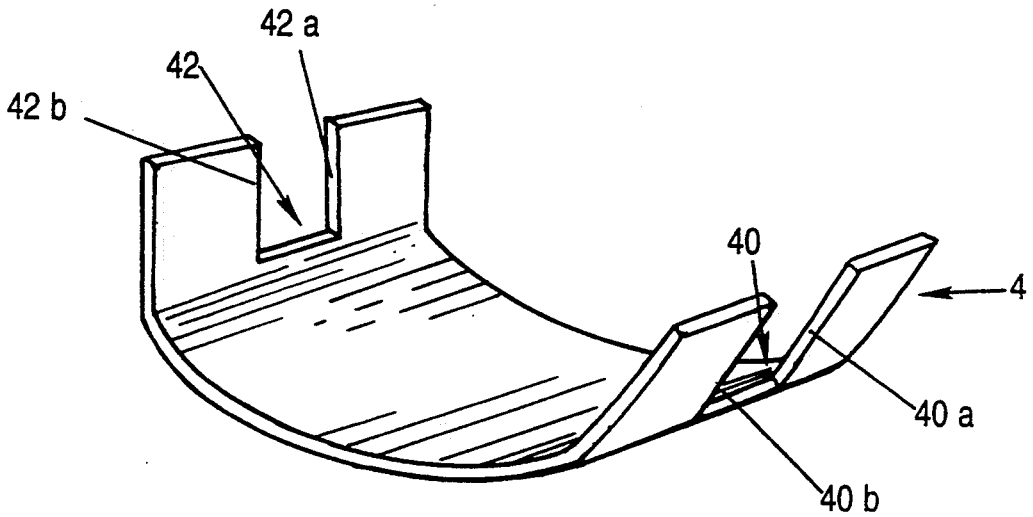
Figure 5C:
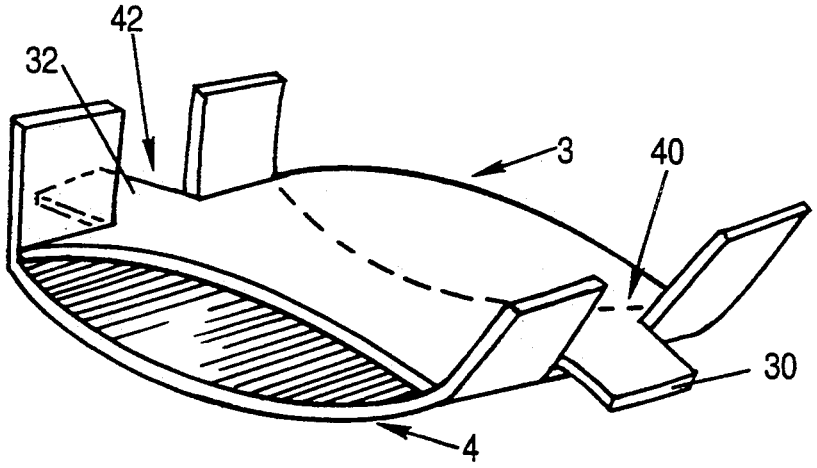

In the latter regard, FIGS. 5A, 5B and 5C are perspective views of the upper strip leaf spring, the lower strip spring, and the upper and lower strip leaf springs assembled and interconnected using a tab-slot arrangement, respectively. As seen in FIG. 5A, the upper strip leaf spring 3 is provided, at each end, with tabs 30 and 32. Tab 30 has sides 30*a* and 30*b* which are angled inwardly so that the tab 30 is wider at its outermost portion than it is at its innermost portion (where it is connected to the main portion of the upper strip leaf spring 3). Similarly, tab 32 has sides 32*a* and 32*b* which are angled inwardly so that the tab 32 is wider at its outermost portion than it is at its innermost portion (where it is joined to the main portion of the upper strip leaf spring 3).

As seen in FIG. 5B, the lower strip leaf spring 4 has slots 40 and 42 provided at each end thereof. Slot 40 has sidewalls 40*a* and 40*b* which are angled so that the slot 40 is narrower at its outermost portion than it is at its innermost portion (nearest the main portion of the lower strip leaf spring 4). Similarly, slot 42 has sidewalls 42*a* and 42*b* which are angled so that the slot 42 is narrower at its outermost portion than at its innermost portion (nearest the main body of the lower strip leaf spring 4).

As shown in FIG. 5C, the upper strip leaf spring 3 is assembled with or interconnected to lower strip leaf spring 4 by placing tab 30 in slot 40 and tab 32 in slot 42. The upper strip leaf spring 3 and lower strip leaf spring 4 are designed and dimensioned so that, during interconnection of the springs 3 and 4, the upper strip leaf spring 3 is bent in the direction indicated by the arrows A and B (in FIG. 5A), and tabs 30 and 32 are inserted into slots 40 and 42, respectively, while the upper strip leaf spring 3 is in the bent configuration. Once the tabs 30 and 32 are inserted into slots 40 and 42, the bending force on upper strip leaf spring 3 is released, and the upper strip spring 3 returns to its original configuration, but the upper strip leaf spring 3 remains assembled to the lower strip leaf spring 4 as a result of the fact that the tabs 30 and 32 are retained in slots 40 and 42, respectively. Tabs 30 and 32 are retained in slots 40 and 42, respectively, as a result of the angled orientation of the sides 30*a*, 30*b* and 32*a*, 32*b* of tabs 30 and 32, respectively, in combination with the angled orientation of the sidewalls 40*a*, 40*b* and 42*a*, 42*b* of slots 40 and 42, respectively, as described above.

Whereas the latter tab-slot arrangement for interconnecting upper strip leaf spring 3 and lower strip spring 4 is a preferred arrangement, it should be recognized that the springs 3 and 4 can also be interconnected by any other suitable means, such as a weld or hinge located at each end of the upper strip leaf spring 3 and/or lower strip leaf spring 4.

Finally, the springs 3 and 4 are, preferably, designed and constructed so that they will flatten completely upon exertion of a force F of, for example, approximately 70–75 pounds, this being the case for a 140–150 pound patient walking with two crutches in parallel. Since crutches are normally used so as to slightly spread laterally outward on each side, it is preferable that the upper strip leaf spring 3 be attached to the attachment cylinder 2 at a slight angle (indicated by reference numerals 7 and 8 in FIG. 4), so that the entire sole 5 will touch the ground during exertion of maximum force F.

In the preferred configuration, the attachment cylinder 2 will be of metal construction, and is made of a standard size to fit most crutches. As mentioned previously, the attachment cylinder 2 is preferably connected to the bottom end of the crutch 1 by a screw or pin (not shown), the screw being preferable for wooden crutches and the pin being preferable for metal crutches. Upper strip leaf spring 3 and lower strip leaf spring 4 are preferably constructed from appropriate spring steel so that, with no force being exerted thereon, they will be spread in a manner as shown in FIG. 1. The non-slip rubber sole 5 is attached to the lower strip leaf spring 4 by use of glue, strong adhesive, or any other suitable means for fastening rubber to metal. The material of the sole 5 is, preferably, a non-slip rubber material such as the material normally used in ordinary shoes. Appropriate ridges and/or a tread is preferably employed, as is commonly the case with ordinary non-slip shoe soles.

While preferred forms and arrangements have been shown in illustrating the invention, it is to be understood that various changes in detail and arrangement may be made without departing from the spirit and scope of this disclosure.

I claim:

1. A deformable shoe for a walking aid, comprising:

connecting means for connecting the shoe to a bottom portion of the walking aid;

an upper strip leaf spring and a lower strip leaf spring, said upper strip leaf spring being connected to said connecting means; and friction means attached to a bottom surface of said lower strip leaf spring for hampering slippage of said deformable shoe;

wherein, when less than a predetermined amount of downward force is exerted on said walking aid, said upper strip leaf spring and said lower strip leaf spring have a configuration such that said upper strip leaf spring is separated from said lower strip leaf spring; and wherein, when at least said predetermined amount of downward force is exerted on said walking aid, said upper strip leaf spring and said lower strip leaf spring are deformed so that said upper strip leaf spring and said lower strip leaf spring become flattened with no space therebetween, said friction means conforming to the shape of the lower strip leaf spring as said lower strip leaf spring changes configuration under the exertion of at least said predetermined amount of downward force.

2. The shoe of claim 1, wherein said connecting means comprises an attachment cylinder for receiving a bottom portion of said walking aid.

3. The shoe of claim 2, wherein said connecting means further comprises a screw horizontally driven through the side of said attachment cylinder and horizontally through the bottom portion of said walking aid, thereby connecting said walking aid to said attachment cylinder.

4. The shoe of claim 2, wherein said connecting means further comprises a pin horizontally driven through the side of said attachment cylinder and horizontally through the bottom portion of said walking aid, thereby connecting said walking aid to said attachment cylinder.

5. The shoe of claim 1, wherein said upper strip leaf spring and said lower strip leaf spring are generally horizontally configured so that the exertion of at least said predetermined amount of downward force on said crutch causes said upper strip leaf spring and said lower strip leaf spring to move toward, and to collapse against, each other.

6. The shoe of claim 1, wherein said friction means comprises a non-slip sole connected to said bottom surface of said lower strip spring, said non-slip sole having a bottom which is ridged.

7. The shoe of claim 1, wherein at least one of said upper strip leaf and said lower strip leaf spring is oriented at an angle relative to said connecting means so that said at least one of said upper strip leaf spring and said lower strip leaf spring lies flat on a surface even though said walking aid is being oriented, during use, at an acute angle relative to said surface.

8. The shoe of claim 1, wherein said upper strip leaf spring and said lower strip leaf spring are formed from spring steel.

9. The shoe of claim 1, wherein said upper strip leaf spring and said lower strip leaf spring are connected at opposite ends thereof by welding.

10. The shoe of claim 1, wherein said upper strip leaf spring and said lower strip leaf spring are connected to each other by hinge-like mechanisms.

11. The shoe of claim 1, wherein said upper strip leaf spring and said lower strip leaf string are connected to each other at respective opposing ends thereof, and said upper strip leaf spring and said lower strip leaf spring are bowed in opposite directions relative to each other when less than said predetermined amount of downward force is exerted on said walking aid.

12. The shoe of claim 1, wherein said lower strip leaf spring is curved when less than said predetermined amount of downward force is exerted on said walking aid, and said lower strip leaf spring has a degree of curvature sufficient to prevent interference of said lower strip leaf spring with the ground during use.

13. The shoe of claim 12, wherein the degree of curvature of said lower strip leaf spring corresponds to forward and backward swinging of the walking aid during use.

14. The shoe of claim 1, wherein said upper strip leaf spring and said lower strip leaf spring are connected to each other by a tab-slot arrangement.

15. The shoe of claim 14, wherein said upper strip leaf spring has two opposing portions which are formed into tabs, each tab having two sidewalls which are angled inwardly so that an outermost portion of said each tab is wider than an innermost portion of said each tab.

16. The shoe of claim 14, wherein said lower strip leaf spring has two opposing end portions, each opposing end portion being discontinuous so as to form a slot therein, each slot having two sidewalls which are each angularly oriented so that an outermost portion of said each slot is narrower than an innermost portion of said each slot.

17. The shoe of claim 1, wherein said lower strip leaf spring has a generally curved shape when less than said predetermined amount of downward force is exerted on said walking aid, and wherein said lower strip leaf spring has a generally flat shape when at least said predetermined amount of downward force is exerted on said walking aid.

* * * * *